US011905782B2

(12) United States Patent
Roy et al.

(10) Patent No.: US 11,905,782 B2
(45) Date of Patent: Feb. 20, 2024

(54) REGULATOR HAVING CHECK VALVE MANIFOLD FOR USE IN SUBSEA CONTROL CIRCUIT

(71) Applicant: National Coupling Company, Inc., Stafford, TX (US)

(72) Inventors: Chris Roy, Sugar Land, TX (US); Frank Harold Hollister, Stafford, TX (US); Nathan Zepeda, Stafford, TX (US); Robert E. Smith, III, Missouri City, TX (US); Josh Williams, Stafford, TX (US)

(73) Assignee: National Coupling Company, Inc., Stafford, TX (US)

( * ) Notice: Subject to any disclaimer, the term of this patent is extended or adjusted under 35 U.S.C. 154(b) by 0 days.

(21) Appl. No.: 18/100,964

(22) Filed: Jan. 24, 2023

(65) Prior Publication Data

US 2023/0287753 A1 Sep. 14, 2023

Related U.S. Application Data

(60) Provisional application No. 63/303,795, filed on Jan. 27, 2022.

(51) Int. Cl.
*E21B 33/035* (2006.01)

(52) U.S. Cl.
CPC ..... *E21B 33/0355* (2013.01); *E21B 2200/02* (2020.05)

(58) Field of Classification Search
CPC ..... E21B 33/0355; E21B 2200/02
See application file for complete search history.

(56) References Cited

U.S. PATENT DOCUMENTS 3,516,491 A * 6/1970 Lewis ..... E21B 33/0355 166/336
3,555,834 A * 1/1971 Weston, Jr. ..... H05K 7/14337 405/185

(Continued)

FOREIGN PATENT DOCUMENTS

| | | |
|---|---|---|
| CN | 202834137 U | 3/2013 |
| EP | 3650724 A1 | 5/2020 |
| WO | 2000008297 A1 | 2/2000 |

OTHER PUBLICATIONS

Search Report in counterpart UK Appl. No. GB2301165.3 dated Jul. 27, 2023. 4-pgs.
Hunting Energy Services, "Pressure Regulators," Brochure, undated, obtained from www.huntingplc.com, 2-pgs.
Pressure Tech, "LF311 Datasheet," Brochure, undated, obtained from www.pressure-tech.com, 4-pgs.

(Continued)

*Primary Examiner* — James G Sayre
(74) *Attorney, Agent, or Firm* — Cabello Hall Zinda, PLLC

(57) ABSTRACT

A regulator valve has a check valve manifold for use in subsea control circuits. For example, the regulator valve having the check valve manifold can be used in a circuit between a directional control valve and an actuator for a gate valve. The check valve manifold can be a flange that attaches to the regulator valve to communicate with the supply and outlet of the regulator valve. Internal communication inside the manifold includes a check valve. If the pressure in the circuit downstream of the regulator valve needs to be vented, the check valve can open to allow the pressure to bleed from the outlet back to the supply without needing to pass through the internal pressure control valve of the regulator.

31 Claims, 7 Drawing Sheets

(56) References Cited

U.S. PATENT DOCUMENTS

| | | | | |
|---|---|---|---|---|
| 4,185,652 | A * | 1/1980 | Zintz | E21B 33/0355 251/25 |
| 4,296,910 | A * | 10/1981 | Gratzmuller | F16K 31/124 91/461 |
| 4,325,409 | A * | 4/1982 | Roberts | E21B 34/045 166/321 |
| 5,277,225 | A * | 1/1994 | Smith | F16L 17/035 137/614.04 |
| 5,771,931 | A * | 6/1998 | Watson | F16K 31/1221 137/236.1 |
| 6,192,680 | B1 * | 2/2001 | Brugman | F15B 21/006 60/413 |
| 9,677,575 | B2 * | 6/2017 | Hilzendegen | F15B 13/06 |
| 2005/0178560 | A1 | 8/2005 | Johansen et al. | |
| 2008/0104951 | A1 * | 5/2008 | Springett | F15B 1/24 60/413 |

OTHER PUBLICATIONS

Pressure Tech, "LF792 Datasheet," Brochure, undated, obtained from www.pressure-tech.com, 4-pgs.

Pressure Tech, "SS231 Datasheet," Brochure, undated, obtained from www.pressure-tech.com, 4-pgs.

Pressure Tech, "SS691 Datasheet," Brochure, undated, obtained from www.pressure-tech.com, 4-pgs.

Pressure Tech, "The SS-231 Series," Manual, dated Mar. 2020, obtained from www.pressure-tech.com, 12-pgs.

Pressure Tech, "The SS-414 Series," Manual, dated Mar. 2020, obtained from www.pressure-tech.com, 12-pgs.

Straval, "Model PRH09," Brochure, undated, obtained from www.straval.com, 4-pgs.

Straval, "Model PRS-07i," Brochure, undated, obtained from www.straval.com, 4-pgs.

* cited by examiner

REGULATOR HAVING CHECK VALVE MANIFOLD FOR USE IN SUBSEA CONTROL CIRCUIT

CROSS-REFERENCE TO RELATED APPLICATIONS

This application claims the benefit of U.S. Provisional Appl. No. 63/303,795 filed Jan. 27, 2022, which is incorporated herein by reference in its entirety.

BACKGROUND OF THE DISCLOSURE

FIG. 1 illustrates a schematic of a prior art control circuit 10 for an actuator 40 of a gate valve 50 used in a subsea control module. The control circuit 10 includes a regulator 20 and a directional control valve (DCV) 30. The regulator 20 connects to a supply 12 of hydraulic fluid and regulates the pressure of the hydraulic fluid for supply to the actuator 40. The directional control valve 30 is downstream of the regulator 20 and includes an inlet (I) connected to the regulator's output (O). A vent (V) of the directional control valve 30 connects to the environment 16 (e.g., seawater). A pilot port (P) of the directional control valve 30 connects to a pilot supply 14.

The regulator 20 reduces the supply pressure of the hydraulic fluid going into the directional control valve 30 to a value suitable for the gate valve actuator 40. When the directional control valve 30 receives a pilot signal at the pilot port (P), the directional control valve 30 opens and sends pressurized hydraulic fluid from the inlet (I) to the output (O) for passage to the gate valve actuator 40 to open the gate valve 50 communicating between lines 52, 54. When the pilot pressure is removed from the directional control valve 30, the directional control valve 30 closes to its default state, which is shown in FIG. 1. For the gate valve 50 to close, the hydraulic pressure above the piston in the actuator 40 must be expelled. The directional control valve 30 has a vent circuit that connects the output (O) to the vent (V) so the hydraulic fluid can exhaust to the environment 16 and the gate valve 50 can close.

Although this arrangement of the control circuit 10 is effective, there may be implementations where this arrangement cannot be used or where different functionality is needed. The subject matter of the present disclosure is directed to overcoming, or at least reducing the effects of, one or more of the problems set forth above.

SUMMARY OF THE DISCLOSURE

A control circuit disclosed here is used for an actuator of a gate valve used in a subsea control module in a subsea environment. The control circuit comprises a directional control valve and a regulator. The directional control valve has: an input in communication with a hydraulic fluid supply, a vent in communication with the subsea environment, a pilot in communication with a pilot supply, and an output. The directional control valve is configured in closed and opened states in response to the pilot supply at the pilot. The directional control valve in the opened state communicates the hydraulic fluid supply at the input with the output. Meanwhile, the directional control valve in the closed state communicates the output with the vent.

The regulator has a supply and an outlet and has a seal arrangement between the supply and the outlet. The supply is in communication with the output of the directional control valve, and the outlet is in communication with the actuator. The seal arrangement is configured to reduce hydraulic pressure of the hydraulic fluid supply communicated from the supply to the outlet, and the seal arrangement is configured to prevent communication of the hydraulic pressure on the outlet to the supply. The regulator has a check valve connecting the supply with the outlet. The check valve is configured to permit at least a portion of the hydraulic pressure at the outlet to bypass the seal arrangement from the outlet to the supply of the regulator to the directional control valve.

An apparatus disclosed herein is used for a subsea control module used in a subsea environment. The apparatus comprises a gate valve, an actuator, a direction control valve, and a regulator. The gate valve has flow connections and has a gate movable between the flow connections. The actuator is connected to the gate valve and is configured to move the gate in response to hydraulic pressure. The directional control valve and the regulator are configured as described above in the control circuit.

A regulator is disclosed herein to regulate hydraulic pressure for an actuator of a gate valve of a subsea control module in a subsea environment. The regulator comprises a housing, a container, a seal arrangement, and a check valve. The housing has a supply and an outlet, and the housing defines an interior communicating with the supply and the outlet. The container is movably disposed in the interior like a piston in response to the hydraulic pressure in the interior.

The seal arrangement is disposed on the container and is movable with the container relative to the supply and the outlet. The seal arrangement is configured to reduce the hydraulic pressure of the hydraulic fluid supply communicated from the supply to the outlet. Additionally, the seal arrangement is configured to prevent communication of the hydraulic pressure on the outlet to the supply. The check valve is disposed in communication between the supply and the outlet. The check valve is configured to perm it at least a portion of the hydraulic pressure at the outlet to bypass the seal arrangement from the outlet to the supply.

The housing can comprise a flow plate having a flow port exposed in the interior and communicating with the supply. The seal arrangement can be biased against the flow plate and can be movable with the container relative to the flow port.

The housing can have a vent side and can comprise a vent plate having a vent port exposed in the interior and communicating with the vent side. The seal arrangement can be biased against the vent plate and can be movable with the container relative to the vent port and the flow port.

The seal arrangement can comprise opposing supply seals disposed in the container and biased away from one another respectively toward the vent plate and the flow plate. Each of the opposing supply seals has a flow passage and a seal face. The seal face is configured to seal with a respective one of the vent plate and flow plate, and the flow passage is configured to produce a pressure change in the hydraulic fluid.

The seal arrangement can comprise opposing vent seals disposed in the container and biased away from one another toward the vent plate and the flow plate. Each of the opposing vent seals has a flow passage and a seal face. The seal face is configured to seal with a respective one of the vent plate and flow plate, and the flow passage is configured to produce a pressure change in the hydraulic fluid.

A manifold can be affixable to the housing. The manifold has a supply port, an outlet port, and the check valve. The supply port can be connected by a supply line to the supply, and the outlet port can be connected by an outline line to the outlet. The outlet line and the supply line are interconnected by the check valve. The check valve is configured to open in response to outlet-side pressure from the outlet line exceeding a level of supply-side pressure from the supply line and is configured to allow the hydraulic fluid pressure from the outlet port to flow back to the supply port, bypassing the interior.

A spring can be disposed in the housing and can bias the container against the hydraulic pressure in the interior.

A method disclosed herein is used for a subsea control module in a subsea environment. The method comprises activating an actuator for a gate valve by: opening a directional control valve communicating a hydraulic fluid supply at an input with an output, and reducing hydraulic pressure of the hydraulic fluid supply from the output to the actuator using a regulator having a supply in communication with the output and having an outlet in communication with the actuator.

The method comprises deactivating the actuator for the gate valve by: closing the directional control valve communicating the output with a vent, preventing communication of the hydraulic pressure on the outlet to the supply of the regulator using a seal arrangement in the regulator, permitting at least a portion of the hydraulic pressure from the actuator to bypass the seal arrangement to the directional control valve through a check valve connecting the outlet to the supply of the regulator, and expelling the hydraulic pressure bypassing the regulator from the vent of the directional control valve to the subsea environment.

The foregoing summary is not intended to summarize each potential embodiment or every aspect of the present disclosure.

DETAILED DESCRIPTION OF THE DISCLOSURE

Figure 2:
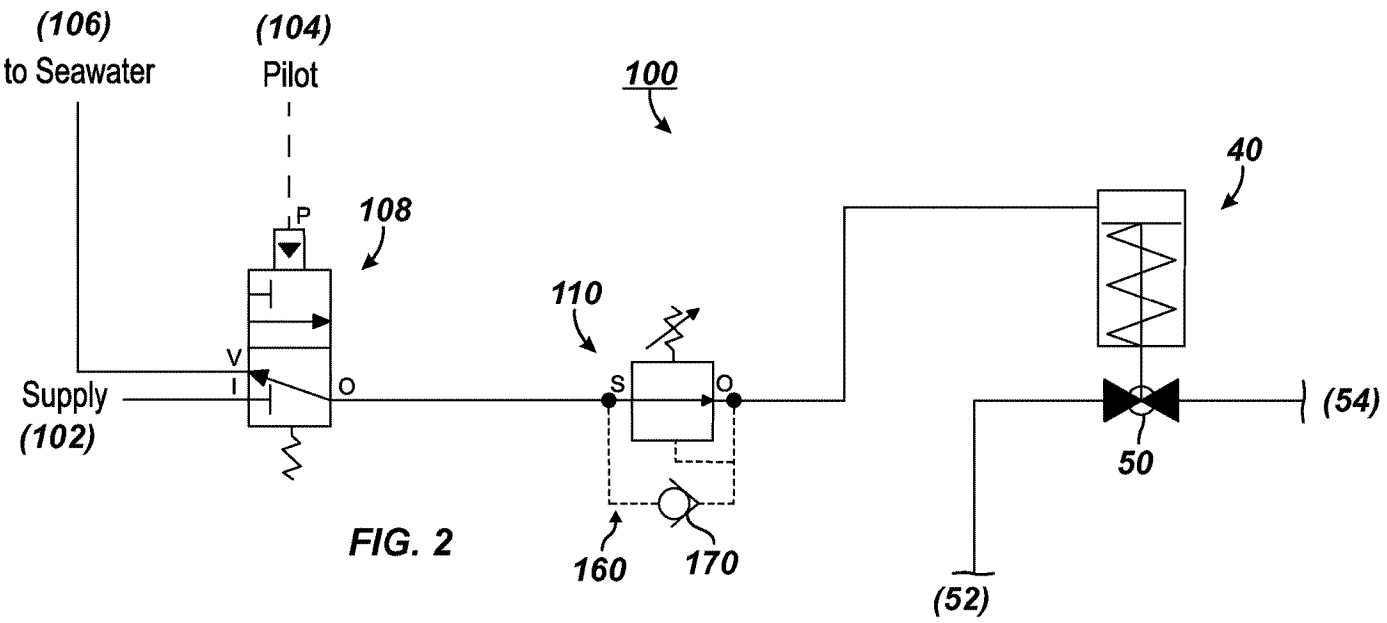
FIG. 2 illustrates a schematic of a control circuit according to the present disclosure for an actuator of a gate valve used in a subsea control module.

FIG. 2 illustrates a schematic of a control circuit 100 of the present disclosure for an actuator 40 of a gate valve 50. As will be appreciated, the control circuit 100 can be used in a Subsea Control Module (SCM) for several functions.

Figure 1:
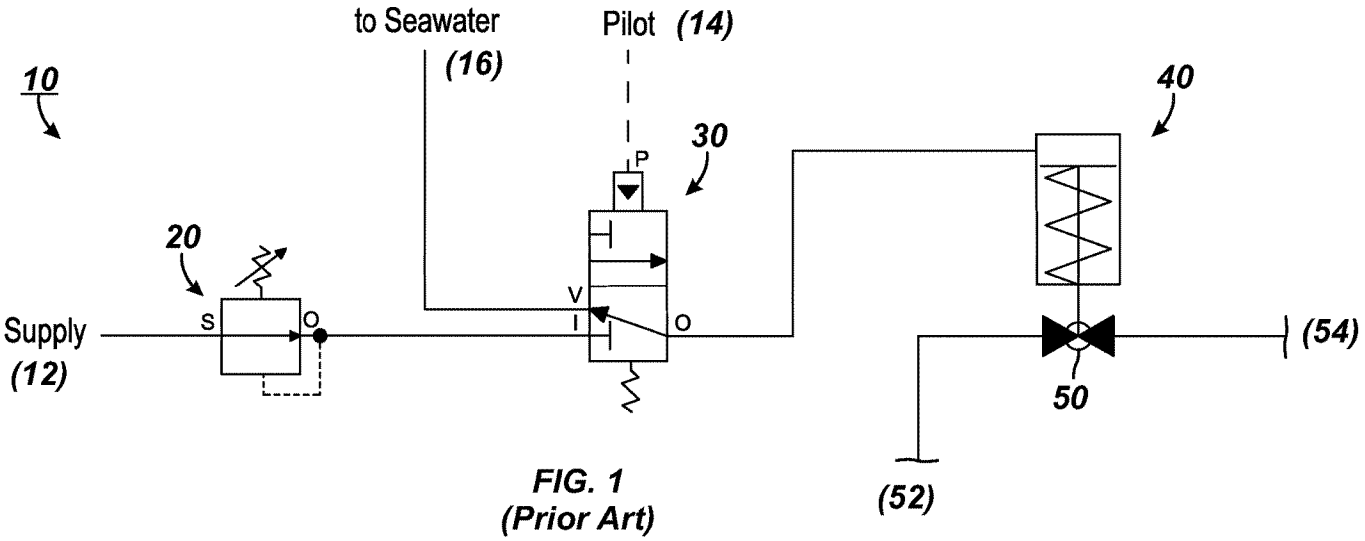
FIG. 1 (Prior Art)
FIG. 1 illustrates a schematic of a prior art control circuit for an actuator of a gate valve used in a subsea control module.

The control circuit 100 includes a regulator 110 and a directional control valve (DCV) 108. In this control circuit 100 and in contrast to the conventional circuit of FIG. 1, the regulator 110 is downstream of the directional control valve 108. This circuit 100 can be used in implementations having mixed operating pressures and can be used in legacy systems where all available lines are utilized, and no more new lines can be added. There may be additional reasons for the arrangement in this control circuit 100.

The directional control valve 108 has an input (I) that connects to a supply 102 of hydraulic control fluid. A vent (V) of the directional control valve 108 connects to the environment 106 (e.g., seawater), and a pilot port (P) of the directional control valve 108 connects to a pilot supply 104. An output (O) of the direction control valve 108 connects to the regulator 110. For its part, the regulator 110 has a supply side (S) connected to the directional control valve 108 and has an outlet side (O) connected to the actuator 40 for the gate valve 50.

The directional control valve 108 can be configured in closed and opened states in response to the pilot supply at the pilot port (P). When the directional control valve 108 receives a pilot signal at the pilot port (P), for example, the directional control valve 108 opens and sends hydraulic control fluid from the input (I) to the output (O). The hydraulic control fluid passes to the regulator 110, which reduces the pressures to a value suitable for the gate valve actuator 40. From there, the hydraulic control fluid goes to the actuator 40, closing the gate valve 50. For example, the gate valve 50 can include a gate being movable by the actuator 40 between an inlet flow connection 52 and an outlet flow connection 54. The flow controlled by the gate valve 50 can be used for any suitable purposes in the subsea control module.

When the pilot signal is removed from the directional control valve 108, the directional control valve 108 closes to a closed state as shown in FIG. 2. Pressure in the line between the regulator 110 and the directional control valve 108 goes out through the vent circuit to the environment 16 by passing from the output (O) to the vent (V). An internal shear seal arrangement of the regulator 110, however, seals off pressure on the outlet side (O) of the regulator 110, preventing that pressure from flowing out the vent circuit in the directional control valve 108. This locks the hydraulic pressure in the gate valve actuator 40 preventing it from closing.

For the gate valve 50 to close, the hydraulic pressure above the piston in the actuator 40 must be expelled. To do this, a manifold 160 having a check valve 170 disposed on the regulator 110 permits the hydraulic fluid to pass from the outlet side (O) to the supply side (S), bypassing the internal seal arrangement of the regulator 110 to the directional control valve 108, where the fluid can then be exhausted through the vent circuit to the environment 106.

Figure 3A:
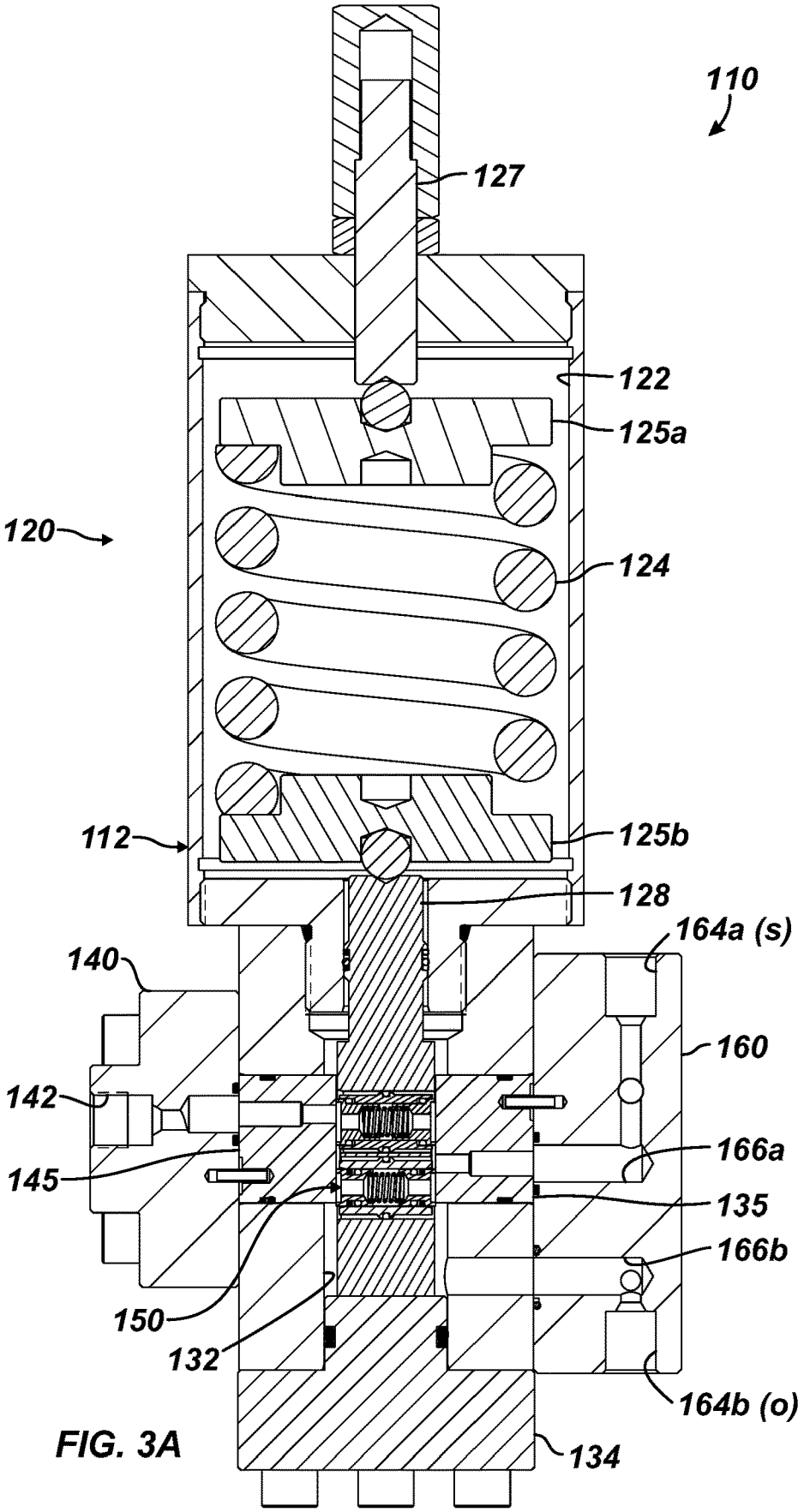
FIG. 3A illustrates a cross-sectional view of a regulator valve of the present disclosure.
Figure 3B:
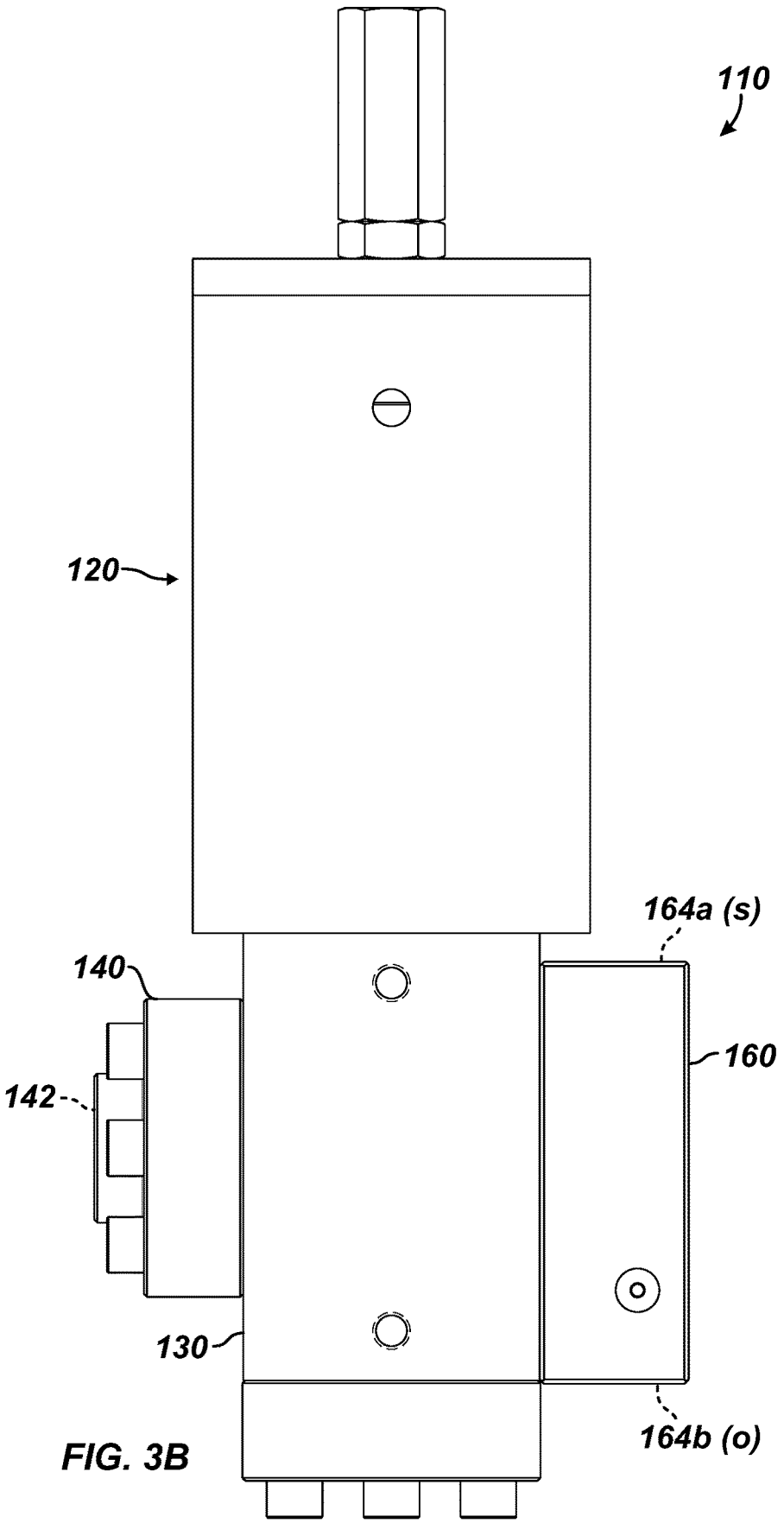
FIG. 3B illustrates a side elevational view of the regulator valve.
Figure 3C:
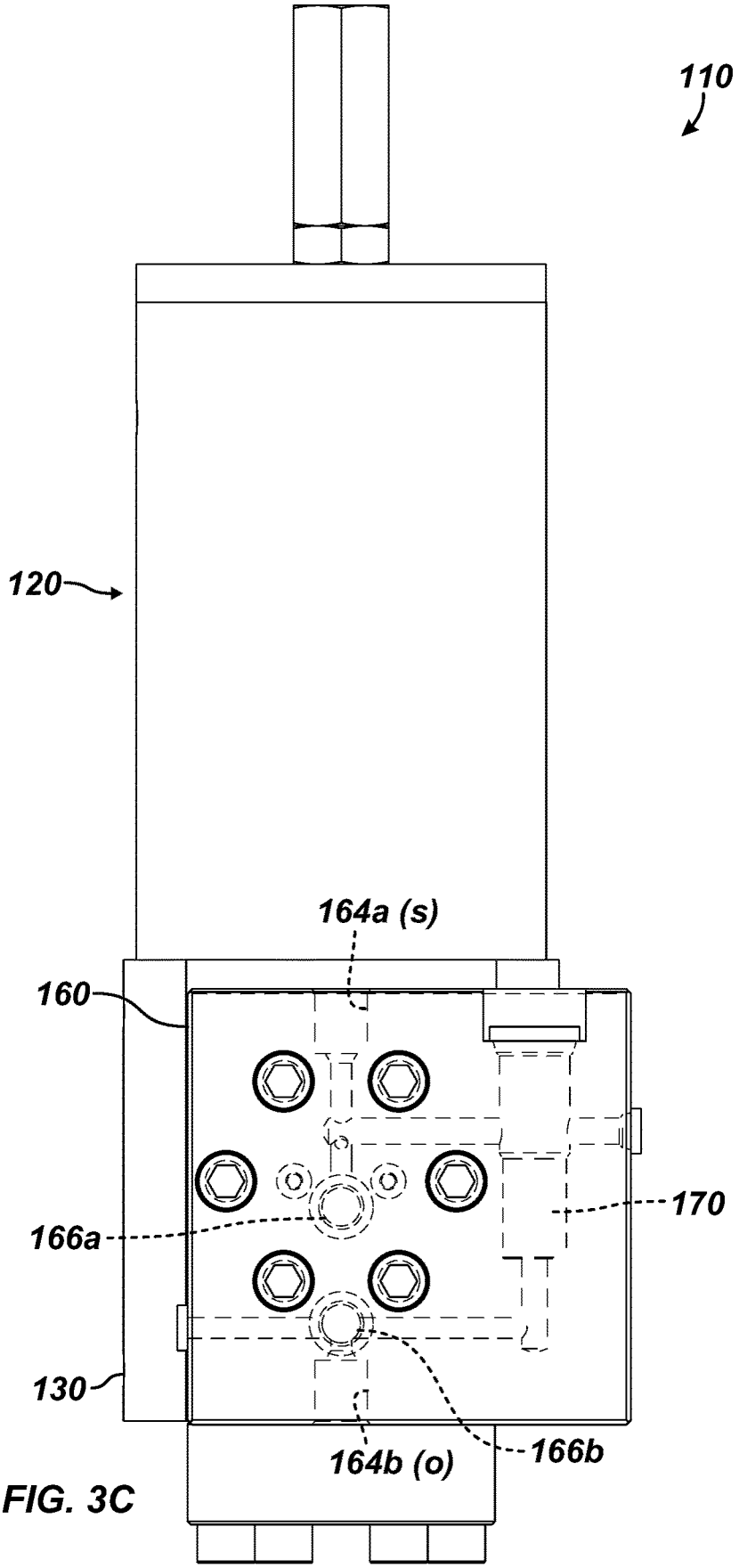
FIG. 3C illustrates a back elevational view of the regulator valve.
Figure 3D:
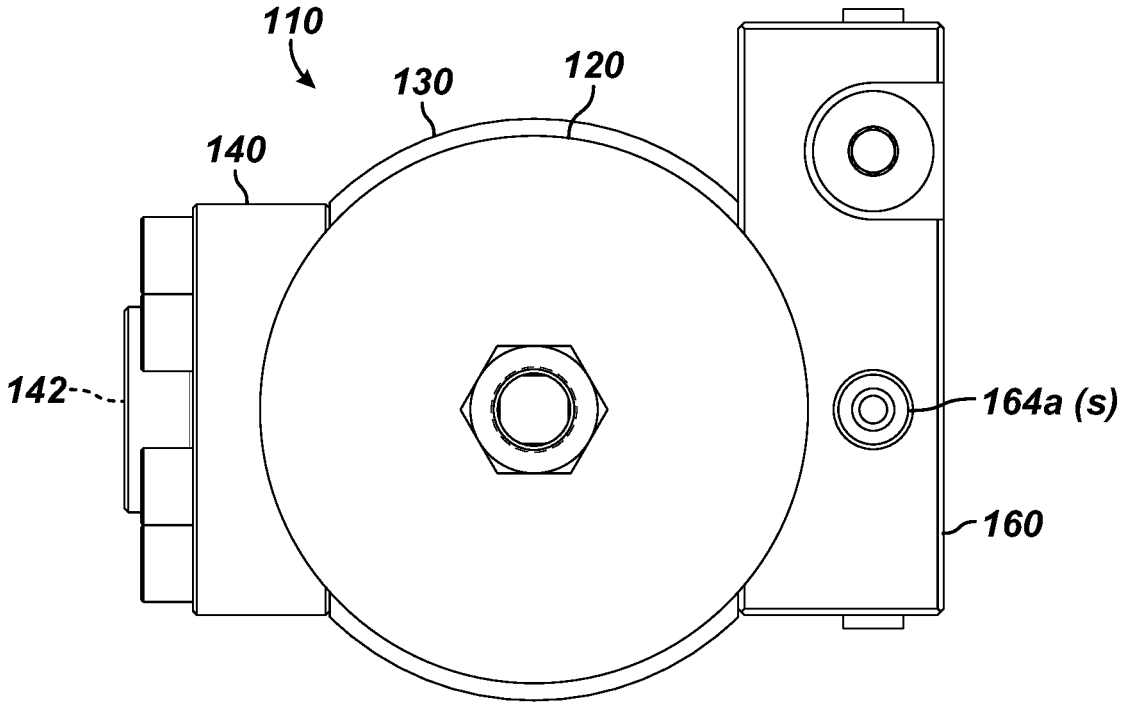
FIG. 3D illustrates a plan view of the top of the regulator valve.
Figure 3E:
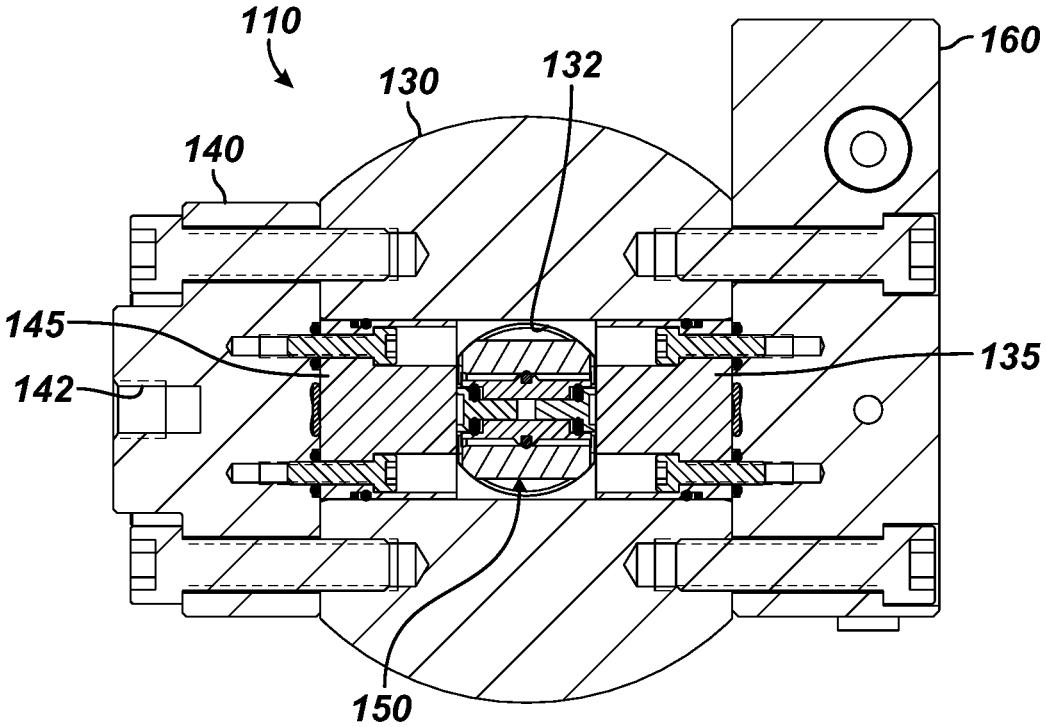
FIG. 3E illustrates an end section of the regulator valve.

FIG. 3A illustrates a cross-sectional view of a regulator valve 110 of the present disclosure; FIG. 3B illustrates a side elevational view of the regulator valve 110; FIG. 3C illustrates a back elevational view of the regulator valve 110; FIG. 3D illustrates a plan view of a top of the regulator valve 110; and FIG. 3E illustrate an end-section of the regulator 110.

The regulator valve 110 includes a housing 112, which is made up of a spring chamber 120, a valve chamber 130, a vent manifold or flange 140, and a control manifold or flange 160. The spring chamber 120 attaches to the valve chamber 130, and the manifolds 140, 160 affix to sides of the valve chamber 130.

The spring chamber 120 holds a spring 124 in the chamber's interior 122 between opposing support plates 125*a-b*. The upper support plate 125*a* is engaged by a bearing and an adjustment screw 127. The lower support plate 125*b* is engaged by a bearing to a seal container or piston 128. The seal container 128 is disposed in an interior or bore 132 of the valve chamber 130. The container 128 holds a configuration of pressure control valves 150, which are shown in detail in FIG. 4. The container 128 is movably disposed in the interior 132 in response to hydraulic pressure in the interior 132 acting against the bias of the spring 124.

The vent manifold 140 mounted to the valve chamber 130 has a vent port 142 that communicates with a vent plate 145 in the valve chamber 130. The interior 132 of the valve chamber 130 communicates through the vent plate 145 with the vent port 142. The vent manifold 140 can be used for venting purposes as needed in a control circuit, such as the circuit 100 in FIG. 2.

The control manifold 160 mounted to the valve chamber 130 has a supply port or inlet 164*a* and a regulated port or outlet 164*b*. As best shown in FIG. 3A, the inlet 164*a* communicates via a supply passage 166*a* with a flow plate 135 in the valve chamber 130, and the interior 132 of the valve chamber 130 communicates via an outlet passage 166*b* to the outlet 164*b*. As generally shown in FIG. 3B, the supply and outlet passages 166*a-b* interconnect with one another via internal lines inside the manifold 160. A check valve 170 described in more detail below prevents fluid communication from the supply passage 166*a* to the outlet passage 166*b* and permits at least some fluid communication from the outlet passage 166*b* to the supply passage 166*a*.

Figure 5:
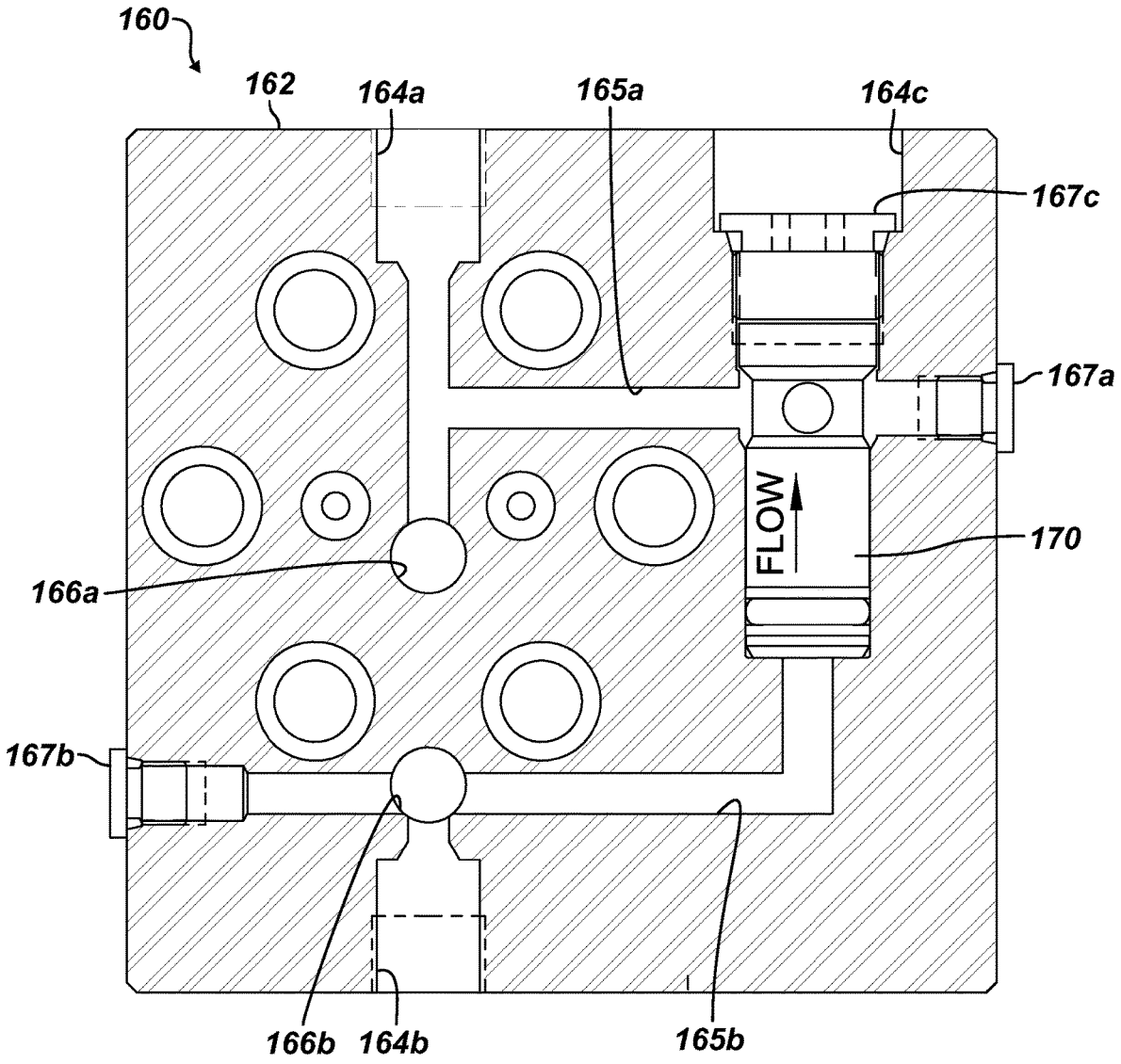
FIG. 5 illustrates a cross-sectional view of a control manifold for the regulator valve.

Additional detail of the control manifold 160 is illustrated in the cross-sectional view of FIG. 5. The control manifold 160 includes a manifold body 162 that can bolt to the valve chamber 130. The supply port 164*a* communicates with an internal supply line 165*a* that connects to the supply passage 166*a* in the manifold body 162. The supply port 164*a* connected to the supply line 165*a* also connects to a supply side of the check valve 170 installed in the manifold body 162.

As seen in FIG. 3A, the supply passage 166*a* communicates with the flow plate 135 of the valve chamber 130. Supply of hydraulic fluid from the directional control valve (108) can enter the valve chamber's interior 132 through the supply passage 166*a* and the flow plate 135 to act upon the seal container 128 and the pressure control valve arrangement 150.

As seen in FIG. 5, the outlet port 164*b* communicates with an outlet line 165*b* that connects to the outlet passage 166*b*. As seen in FIG. 3A, this outlet passage 166*b* communicates with the interior 132 of the valve chamber 130. Regulated hydraulic fluid from the valve chamber's interior 132 can pass through the outlet passage 166*b* to the outlet port 164*b* of the manifold 160.

Additionally as shown in FIG. 5, the outlet line 165*b* connects the outlet port 164*b* to an outlet side of the check valve 170. Inside the manifold 160, the check valve 170 has supply-side pressure (from line 165*a*) and outlet-side pressure (from line 165*b*) acting on it. When the outlet-side pressure from the outlet line 165*b* exceeds the supply-side pressure from the supply line 165*a* (including any internal bias of the check valve 170), the check valve 170 opens and allows the hydraulic fluid from the outlet port 164*b* to flow back to the supply port 164*a*, bypassing the interior 132 of the valve chamber 130 of the regulator valve 110 and relieving the hydraulic pressure downstream from the regulator 110.

For manufacturing and machining purposes, side access points of the communication lines 165*a-b* have sealed plugs 167*b*. The side access 164*c* for insertion of the check valve 170 also includes a sealed plug 167*c*.

As noted above with respect to the control circuit 100 in FIG. 2, when the pilot signal is removed from the directional control valve 108, the directional control valve 108 closes. Pressure between the regulator 110 and the directional control valve 108 goes out through the vent circuit to the environment 16. The internal seal arrangement of the regulator 110, however, seals off pressure on the outlet side (O) of the regulator 110, preventing that pressure from flowing back through the regulator 110 to the supply side (S). Here, however, the check valve 170 permits the hydraulic fluid to flow around the internal seals of the regulator 110 and to flow back to the directional control valve 108. In this way, the hydraulic fluid can then bleed out the vent circuit in the directional control valve 108 and can be exhausted through the vent circuit to the environment 106.

Figure 4:
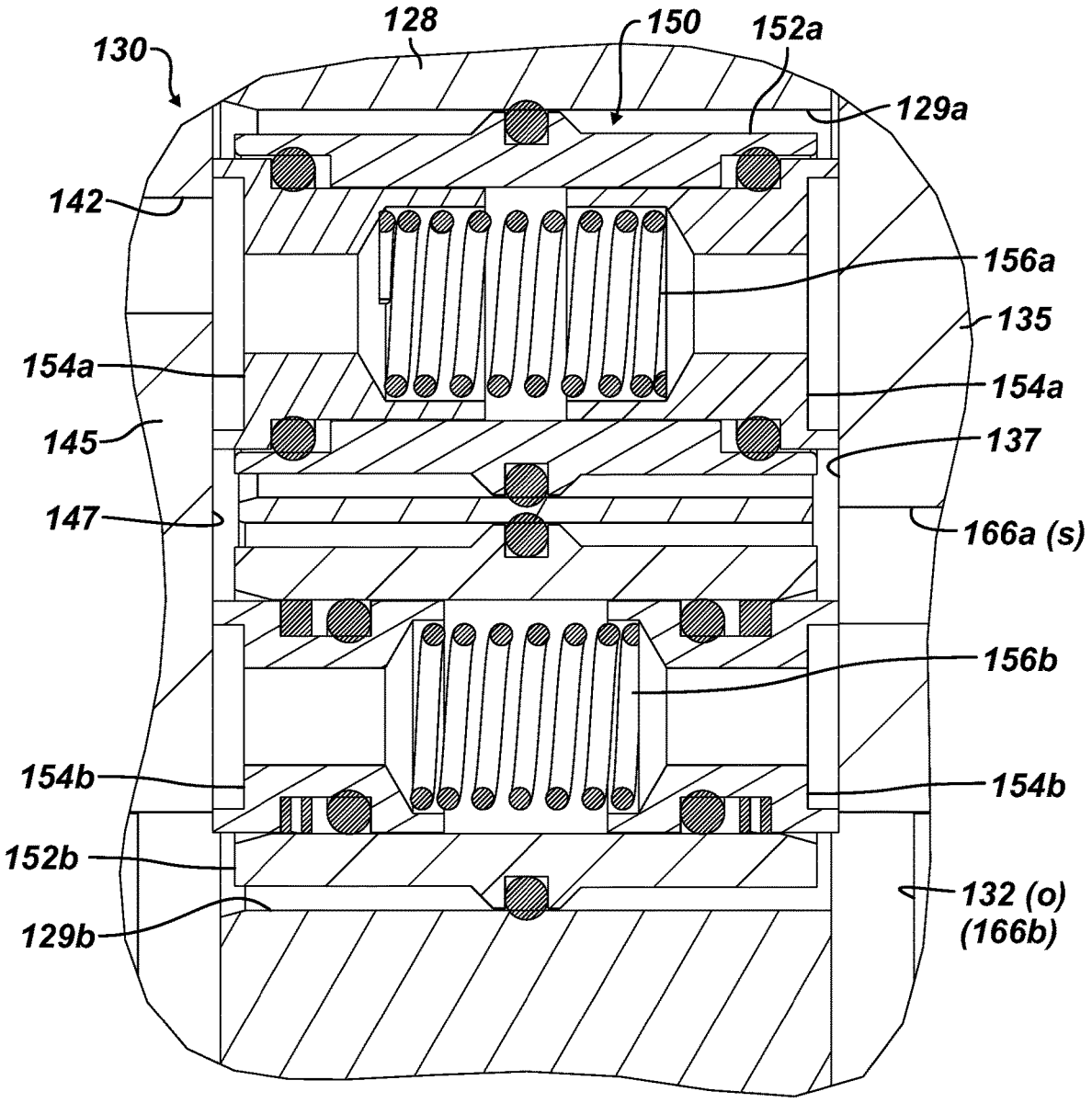
FIG. 4 illustrates a detailed cross-section of a pressure control valve arrangement in the regulator valve.

FIG. 4 illustrates a detailed cross-section of the internal seal arrangement 150 for the pressure control used inside the regulator valve's chamber 130. An outlet seal cage 152*a* is disposed in a first pocket 129*a* of the seal container 128 and is sealed therein with an annular O-ring seal. The outlet seal cage 152*a* holds opposing vent seals 154*a* therein. Annular O-ring seals are used to seal the vent seals 154*a* in the outlet seal cage 152*a*. The vent seals 154*a* define a flow passage therethrough and have a circumferential seal face disposed thereabout on the outer end. The opposing vent seals 154*a* can move laterally in response to hydraulic pressure and are biased away from one another by a central spring 156*a*. When biased outward, the faces of the vent seals 154*a* respectively engage internal surfaces 147, 137 of the flow plates 145, 135, which are exposed on opposing sides of the interior 132 to form shear seals. The flow passages in the vent seals 154*a* have a change in diameter to produce a pressure change (e.g., pressure drop) in the hydraulic fluid allowed to pass through the vent seals 154*a*.

In a similar manner, an inlet seal cage 152*b* is disposed in a second pocket 129*b* of the seal container 128 and is sealed therein with an annular O-ring seal. The inlet seal cage 152*b* holds opposing supply seals 154*b* therein. Annular O-ring seals and backup seals are used to seal the supply seals 154*b* in the inlet seal cage 152*b*. The supply seals 154*b* define a flow passage therethrough and have a circumferential seal face disposed thereabout on the outer end. The opposing supply seals 154*b* can move laterally in response to hydraulic pressure and are biased away from one another by a central spring 156*b*. When biased outward, the faces of the supply seals 154*b* respectively engage the surfaces 147, 137 of the flow plates 145, 135 on opposing sides of the interior 132 to form shear seals. The flow passages in the supply seals 154*b* have a change in diameter to produce a pressure change (e.g., pressure drop) in the hydraulic fluid allowed to pass through the supply seals 154*b*.

The seals 154*a-b* of the seal arrangement 150 control the flow and the pressure of the hydraulic fluid communicated from the supply side S (e.g., 166*a*, 164*a*) to the outlet side O (e.g., 166*b*, 164*b*) communicating with the interior 132 of the regulator 110. As can be seen, the vent seals 154*a* throttle cross-flow between them, but the faces of the vent seals 154*a* slidably seal on the flat surfaces 147, 137 of the flow plates 145, 135. The vent seals 154*a* can unseal from the faces 147, 137 against the bias of the central spring 156*a* in response to hydraulic pressure, and the vent seals 154*a* can slide along the faces 147, 137 with movement of the carrier 128 against the bias of the valve's spring (127). One vent seal 154*a* seals adjacent the vent passage 142, while the other vent seal 154*a* seals adjacent the supply passage 166*a*.

The supply seals 154*b* throttle cross-flow between them, but the faces of the supply seals 154*b* slidably seal on the flat surfaces 147, 137 of the flow plates 145, 135. The supply seals 154*b* can unseal from the faces 147, 137 against the bias of the central spring 156*b* in response to hydraulic pressure, and the supply seals 154*b* can slide along the faces 147, 137 with movement of the carrier 128 against the bias of the valve's spring (127). One supply seal 154*b* seals adjacent the interior 132 that communicates with the outlet passage 166*b*, while the other supply seal 154*a* seals adjacent the supply passage 166*a* and outlet passage 166*b*.

The regulator valve 110 of the present disclosure may be used with or without the control manifold 160 having the check valve 170. Without the control manifold 160 and using an appropriate flow manifold for the supply and outlet, the regulator valve 110 can be used in a conventional circuit 10 such as discussed above with respect to FIG. 1. With the control manifold 160 having the check valve 170, however, the regulator valve 110 can be used in the alternative control circuit 100, such as discussed above with respect to FIG. 2. However, the regulator valve 110 having the control manifold 160 with the check valve 170 may also be used in the conventional control circuit 10 to provide additional functionality.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

What is claimed is:

1. A control circuit for an actuator of a gate valve used in a subsea control module in a subsea environment, the control circuit comprising:

a directional control valve having: an input in communication with a hydraulic fluid supply, a vent in communication with the subsea environment, a pilot in communication with a pilot supply, and an output, the directional control valve configured in closed and opened states in response to the pilot supply at the pilot, the directional control valve in the opened state communicating the hydraulic fluid supply at the input with the output, the directional control valve in the closed state communicating the output with the vent; and a regulator having a supply and an outlet and having a seal arrangement between the supply and the outlet, the supply in communication with the output of the directional control valve, the outlet in communication with the actuator, the seal arrangement being configured to reduce hydraulic pressure of the hydraulic fluid supply communicated from the supply to the outlet, the seal arrangement configured to prevent communication of the hydraulic pressure on the outlet to the supply, the regulator having a check valve connecting the supply with the outlet, the check valve being configured to permit at least a portion of the hydraulic pressure at the outlet to bypass the seal arrangement from the outlet to the supply of the regulator to the directional control valve.

2. The control circuit of claim 1, wherein the regulator comprises:

a housing having the supply and the outlet, the housing defining an interior communicating with the supply and the outlet; and a container movably disposed in the interior in response to the hydraulic pressure in the interior, wherein the seal arrangement is disposed on the container and is movable with the container relative to the supply and the outlet.

3. The control circuit of claim 2, wherein:

the housing comprises a flow plate having a flow port exposed in the interior and communicating with the supply; and the seal arrangement is biased against the flow plate and is movable with the container relative to the flow port.

4. The control circuit of claim 3, wherein the housing has a vent side;

the housing comprises a vent plate having a vent port exposed in the interior and communicating with the vent side; and the seal arrangement is biased against the vent plate and is movable with the container relative to the vent port and the flow port.

5. The control circuit of claim 4, wherein the seal arrangement comprises:

opposing supply seals disposed in the container and biased away from one another respectively toward the vent plate and the flow plate, each of the opposing supply seals having a flow passage and a seal face, the seal face being configured to seal with a respective one of the vent plate and flow plate, the flow passage being configured to produce a pressure change in the hydraulic fluid; and opposing vent seals disposed in the container and biased away from one another toward the vent plate and the flow plate, each of the opposing vent seals having a flow passage and a seal face, the seal face being configured to seal with a respective one of the vent plate and flow plate, the flow passage being configured to produce a pressure change in the hydraulic fluid.

6. The control circuit of claim 4, comprising a manifold affixable to the housing, the manifold having a supply port, an outlet port, and the check valve, the supply port connected by a supply line to the supply, the outlet port connected by an outlet line to the outlet, the outlet line and the supply line interconnected by the check valve, the check valve configured to open in response to outlet-side pressure from the outlet line exceeding a level of supply-side pressure from the supply line and configured to allow the hydraulic pressure from the outlet port to flow back to the supply port, bypassing the interior.

7. The control circuit of claim 2, comprising a spring disposed in the housing and biasing the container against the hydraulic pressure in the interior.

8. An apparatus for a subsea control module used in a subsea environment, the apparatus comprising:

a gate valve having flow connections and having a gate movable between the flow connections;

an actuator connected to the gate valve and being configured to move the gate in response to hydraulic pressure;

a directional control valve having: an input in communication with a hydraulic fluid supply, a vent in communication with the subsea environment, a pilot in communication with a pilot supply, and an output, the directional control valve configured in closed and opened states in response to the pilot supply at the pilot, the directional control valve in the opened state communicating the hydraulic fluid supply at the input with the output, the directional control valve in the closed state communicating the output with the vent; and a regulator having a supply and an outlet and having a seal arrangement between the supply and the outlet, the supply in communication with the output of the directional control valve, the outlet in communication with the actuator, the regulator being configured to reduce hydraulic fluid pressure of the hydraulic fluid supply communicated from the supply to the outlet, the seal arrangement being configured to prevent communication of the hydraulic fluid pressure on the outlet to the supply, the regulator having a check valve connecting the supply with the outlet, the check valve being configured to permit at least a portion of the hydraulic fluid pressure at the outlet to bypass the seal arrangement from the outlet to the supply of the regulator to the directional control valve.

9. The apparatus of claim 8, wherein the regulator comprises:

a housing having the supply and the outlet, the housing defining an interior communicating with the supply and the outlet; and a container movably disposed in the interior in response to the hydraulic pressure in the interior, wherein the seal arrangement is disposed on the container and is movable with the container relative to the supply and the outlet.

10. The apparatus of claim 9, wherein:

the housing comprises a flow plate having a flow port exposed in the interior and communicating with the supply; and the seal arrangement is biased against the flow plate and is movable with the container relative to the flow port.

11. The apparatus of claim 10, wherein:

the housing has a vent side;

the housing comprises a vent plate having a vent port exposed in the interior and communicating with the vent side; and the seal arrangement is biased against the vent plate and is movable with the container relative to the vent port and the flow port.

12. The apparatus of claim 11, wherein the seal arrangement comprises:

opposing supply seals disposed in the container and biased away from one another respectively toward the vent plate and the flow plate, each of the opposing supply seals having a flow passage and a seal face, the seal face being configured to seal with a respective one of the vent plate and flow plate, the flow passage being configured to produce a pressure change in the hydraulic fluid pressure; and opposing vent seals disposed in the container and biased away from one another toward the vent plate and the flow plate, each of the opposing vent seals having a flow passage and a seal face, the seal face being configured to seal with a respective one of the vent plate and flow plate, the flow passage being configured to produce a pressure change in the hydraulic fluid pressure.

13. The apparatus of claim 9, comprising a manifold affixable to the housing, the manifold having a supply port, an outlet port, and the check valve, the supply port connected by a supply line to the supply, the outlet port connected by an outlet line to the outlet, the outlet line and the supply line interconnected by the check valve, the check valve configured to open in response to outlet-side pressure from the outlet line exceeding a level of supply-side pressure from the supply line and configured to allow the hydraulic fluid pressure from the outlet port to flow back to the supply port, bypassing the interior.

14. The apparatus of claim 9, comprising a spring disposed in the housing and biasing the container against the hydraulic pressure in the interior.

15. The apparatus of claim 9, wherein:

the housing comprises first and second opposing plates, the first opposing plate having a flow port exposed in the interior and communicating with the supply; and the seal arrangement comprises opposing seals disposed in the container and biased away from one another respectively toward the first and second opposing plates, each of the opposing seals having a flow passage and a seal face, the seal face being configured to seal with a respective one of the first and second opposing plates, the flow passage being configured to produce a pressure change in the hydraulic fluid pressure.

16. A regulator to regulate hydraulic pressure of hydraulic fluid for an actuator of a gate valve of a subsea control module in a subsea environment, the regulator comprising:

a housing having a supply and an outlet, the housing defining an interior communicating with the supply and the outlet;

a container movably disposed in the interior in response to the hydraulic pressure in the interior;

a seal arrangement disposed on the container and being movable with the container relative to the supply and the outlet, the seal arrangement being configured to reduce the hydraulic pressure of the hydraulic fluid communicated from the supply to the outlet, the seal arrangement being configured to prevent communication of the hydraulic pressure on the outlet to the supply; and a check valve disposed in communication between the supply and the outlet, the check valve being configured to permit at least a portion of the hydraulic pressure at the outlet to bypass the seal arrangement from the outlet to the supply.

17. The actuator of claim 16, wherein the housing comprises a flow plate having a flow port exposed in the interior and communicating with the supply, wherein the seal arrangement is biased against the flow plate and is movable with the container relative to the flow port.

18. The regulator of claim 17, wherein the housing has a vent side; and wherein the housing comprises a vent plate having a vent port exposed in the interior and communicating with the vent side, wherein the seal arrangement is biased against the vent plate and is movable with the container relative to the vent port and the flow port.

19. The regulator of claim 18, wherein the seal arrangement comprises opposing supply seals disposed in the container and biased away from one another respectively toward the vent plate and the flow plate, each of the opposing supply seals having a flow passage and a seal face, the seal face being configured to seal with a respective one of the vent plate and flow plate, the flow passage being configured to produce a pressure change in the hydraulic fluid.

20. The regulator of claim 18, wherein the seal arrangement comprises opposing vent seals disposed in the container and biased away from one another toward the vent plate and the flow plate, each of the opposing vent seals having a flow passage and a seal face, the seal face being configured to seal with a respective one of the vent plate and flow plate, the flow passage being configured to produce a pressure change in the hydraulic fluid.

21. The regulator of claim 16, comprising a manifold affixable to the housing, the manifold having a supply port, an outlet port, and the check valve, the supply port connected by a supply line to the supply, the outlet port connected by an outlet line to the outlet, the outlet line and the supply line interconnected by the check valve, the check valve configured to open in response to outlet-side pressure from the outlet line exceeding a level of supply-side pressure from the supply line and configured to allow the hydraulic pressure from the outlet port to flow back to the supply port, bypassing the interior.

22. The regulator of claim 16, comprising a spring disposed in the housing and biasing the container against the hydraulic pressure in the interior.

23. The regulator of claim 16, wherein:

the housing comprises first and second opposing plates, the first opposing plate having a flow port exposed in the interior and communicating with the supply; and the seal arrangement comprises opposing seals disposed in the container and biased away from one another respectively toward the first and second opposing plates, each of the opposing seals having a flow passage and a seal face, the seal face being configured to seal with a respective one of the first and second opposing plates, the flow passage being configured to produce a pressure change in the hydraulic fluid pressure.

24. A method used for a subsea control module in a subsea environment, the method comprising:

activating an actuator for a gate valve by:

opening a directional control valve communicating a hydraulic fluid supply at an input with an output, and reducing hydraulic pressure of the hydraulic fluid supply from the output to the actuator using a regulator having a supply in communication with the output and having an outlet in communication with the actuator; and deactivating the actuator for the gate valve by:

closing the directional control valve communicating the output with a vent, preventing communication of the hydraulic pressure at the outlet to the supply of the regulator using a seal arrangement in the regulator, permitting at least a portion of the hydraulic pressure from the actuator to bypass the seal arrangement to the directional control valve through a check valve connecting the outlet to the supply of the regulator, and expelling the hydraulic pressure bypassing the regulator from the vent of the directional control valve to the subsea environment.

25. The method of claim 24, wherein opening and closing the directional control valve comprises communicating a pilot supply with a pilot on the directional control valve and changing the directional control valve between closed and opened states in response to the pilot supply at the pilot.

26. The method of claim 24, wherein reducing the hydraulic pressure of the hydraulic fluid supply from the output to the actuator using the regulator comprising:

communicating the supply with a first port defined in a first plate disposed in an interior of the regulator;

biasing the seal arrangement in the interior relative to the first plate; and moving the seal arrangement in the interior relative to the first port by moving a container in the interior, the container having the seal arrangement disposed thereon.

27. The method of claim 26, further biasing the container against the hydraulic pressure in the interior using a spring disposed in the regulator.

28. The method of claim 26, further comprising:

communicating the interior with a second port defined in a second plate on disposed in the interior of the regulator;

biasing the seal arrangement in the interior relative to the second plate; and moving the seal arrangement in the interior relative to the second port by moving the container in the interior.

29. The method of claim 28, wherein biasing the seal arrangement relative to the first and second plates comprises biasing opposing first seals disposed in the container and biased away from one another respectively toward the first and second plates, each of the opposing first seals having a flow passage and a seal face, the seal face being configured to seal with a respective one of the first and second plates, the flow passage being configured to produce a pressure change in the hydraulic fluid.

30. The method of claim 28, wherein biasing the seal arrangement relative to the first and second plates comprises biasing opposing second seals disposed in the container and biased away from one another toward the first and second plates, each of the opposing second seals having a flow passage and a seal face, the seal face being configured to seal with a respective one of the first and second plates, the flow passage being configured to produce a pressure change in the hydraulic fluid.

31. The method of claim 24, wherein permitting at least the portion of the hydraulic pressure from the actuator to bypass the seal arrangement to the directional control valve through the check valve connecting the outlet to the supply of the regulator comprises opening the check valve in response to outlet-side pressure from the outlet exceeding a level of supply-side pressure from the supply and allowing the hydraulic pressure from the outlet to flow back to the supply, bypassing the seal arrangement in an interior of the regulator.

* * * * *